US005443205A

United States Patent [19]

Robotham et al.

[11] Patent Number: 5,443,205

[45] Date of Patent: Aug. 22, 1995

[54] SHIPPING/DISPLAY CONTAINER

[75] Inventors: James O. Robotham, Nashville, Mich.; Noel J. Mertz, Geneva, Ill.

[73] Assignee: Kellogg Company, Battle Creek, Mich.

[21] Appl. No.: 217,158

[22] Filed: Mar. 24, 1994

[51] Int. Cl.[6] ..... B65D 5/32; B65D 5/54

[52] U.S. Cl. ..... 229/243; 229/23 BT; 229/125.19; 229/125.32

[58] Field of Search ..... 229/23 R, 23 BT, 123.2, 229/123.3, 125.32, 243, 125.19

[56] References Cited

U.S. PATENT DOCUMENTS

| | | | |
|---|---|---|---|
| 1,886,211 | 11/1932 | Mix | 229/125.19 |
| 3,064,876 | 11/1962 | Warner | 229/125.19 |
| 3,187,976 | 6/1965 | Struble | 229/125.32 |
| 3,653,577 | 4/1972 | Wyner | 229/23 R |
| 3,967,774 | 7/1976 | Querner | 229/125.19 |
| 4,784,271 | 11/1988 | Wosaba, II et al. | 220/418 |
| 5,105,950 | 4/1992 | Gottfreid et al. | 229/125.19 |

FOREIGN PATENT DOCUMENTS

| | | | |
|---|---|---|---|
| 345351 | 11/1904 | France | 229/123.3 |
| 3609608 | 8/1987 | Germany . | |
| 3940872 | 6/1991 | Germany | 229/23 R |
| 2011356 | 7/1979 | United Kingdom | 229/23 R |

OTHER PUBLICATIONS

German Gebrauchsmuster Abstract GM 8418806.
Translation of DE 3,940,872 A1 cited in the first office action.

*Primary Examiner*—Gary E. Elkins

[57] ABSTRACT

A shipping/display container includes top panels and side panels hingedly attached thereto forming a shroud. The container includes a bottom panel and lower side panels hingedly attached thereto forming a tray. The side panels of the shroud are disposed inside the lower side panels and against the bottom panel. The lower side panels of the tray have at least two flaps attached to at least two lower side panels of the tray at lines of demarcation therebetween. The flaps are adhered to the side panels of the shroud.

13 Claims, 3 Drawing Sheets

SHIPPING/DISPLAY CONTAINER

This invention relates to shipping/display containers, and more particularly, to shipping containers of the type that is intended to be converted into a display after opening at the destination point. The invention is further related to shipping containers that can readily be opened using a knife or other sharp instrument without danger of cutting cartons held within the container.

BACKGROUND OF THE INVENTION

One type of shipping container that can be converted into a display tray avoids the use of a knife or sharp cutting instrument in order to prevent cutting open one or more cartons held within the container. To this end, the shipping container of U.S. Pat. No.4,784,271 utilizes a tear strip for tearing a wide adhesive tape for separating the upper portion of the shipping container from the bottom tray portion.

U.S. Pat. No. 5,105,950 relates to a cardboard carton lid so constructed that the carton may be securely packed and without the necessity for plastic strapping. The lid has elongated side panels with two parallel lines of weakness (e.g., perforations) formed in each of them. The bottom, fastening portion of the side panels is secured, as by adhesive, to the carton body side walls. The carton is packed with non-deformable material such as business forms which extend above the top edge of the carton. After the lid is compressed, the components are maintained in the compressed condition and the side panels are glued to the carton body side walls. A user can grasp the strip between the liner of weakness and detach the lid, leaving the lid with an uneven, unsightly boundary.

It is another object of the invention to provide a new and improved shipping/display container which avoids one or more of the disadvantages of such prior containers.

It is an object of the invention to provide a new and improved shipping/display container that can be opened using a knife or other sharp instrument.

It is another object of the invention to provide a new and improved shipping/display container of simplified construction.

SUMMARY OF THE INVENTION

In accordance with the invention, a container adapted to ship and display a boxed product comprises a top panel and side panels hingedly attached thereto forming a shroud. The container includes a bottom panel and lower side panels hingedly attached thereto forming a tray. The side panels of the shroud are disposed inside the lower side panels of the tray and rest against the bottom panel, thereby encasing the boxed product. The lower side panels of the tray have at least two flaps attached to at least two lower side panels of the tray at lines of demarcation therebetween. The flaps are adhered to the side panels of the shroud, whereby the flaps are adapted to be detached from the lower side panels of the tray and the shroud is adapted to be removed from the container to display the boxed product.

BRIEF DESCRIPTION OF THE DRAWINGS

Referring now to the drawings.

DESCRIPTION OF THE PREFERRED EMBODIMENT

Figure 1:
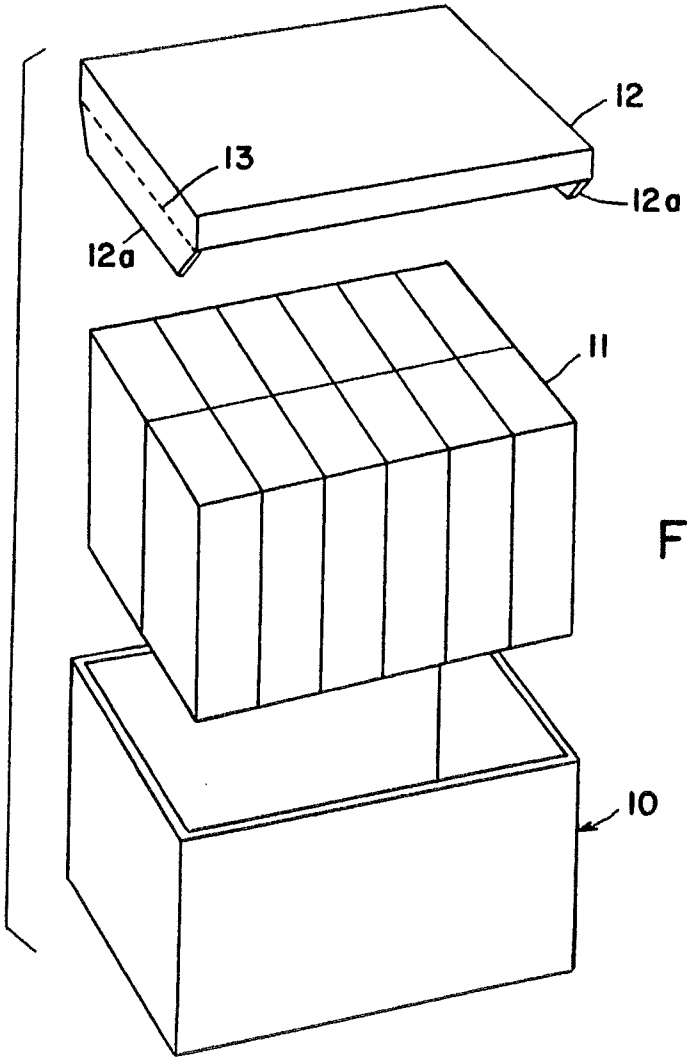
FIG. 1 is an exploded view of a shipping/display container with cartons to be loaded therein with the container in the loading position which is inverted with respect to its display position.

Referring now more particularly to FIG. 1 of the drawings, there is represented a shipping/display container 10 in inverted position and in an exploded view to represent how the container is loaded with boxes or cartons 11 containing, for example, cereal. A panel 12 which in inverted view is a top panel but in display position is a bottom panel is represented as a cover for the cartons 11 in the container 10.

Figure 2:
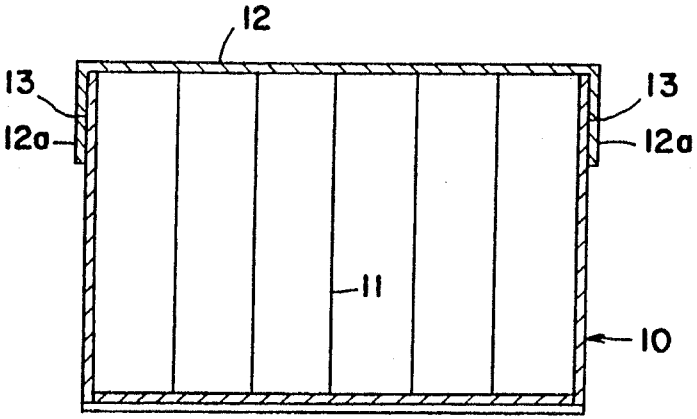
FIG. 2 is a longitudinal sectional view of the FIG. 1 container with cartons loaded therein.

FIG. 2 is a longitudinal sectional view of the container 10 loaded with cartons 11 and having container 12 adhered thereto by, for example, glue at selected positions between the side flaps of the panel 12 and the container 10.

In FIG. 1 the side flaps of the container 12 preferably are the end flaps 12*a* below the lines of demarcation 13, one of which may be seen in FIG. 1 and which are indicated in FIG. 2.

Figure 3:
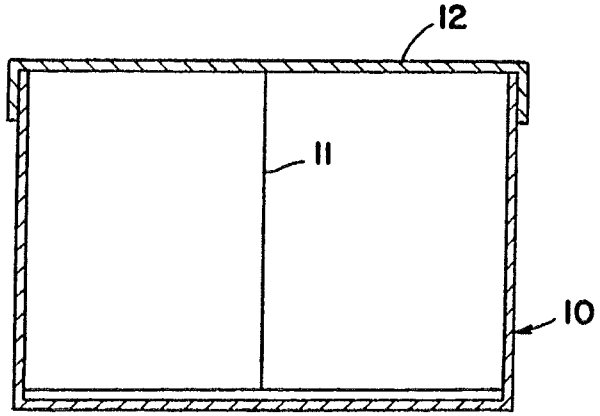
FIG. 3 is a side sectional view of the FIG. 1 container with cartons loaded therein taken at right angles to the FIG. 2 sectional view.

FIG. 3 is a sectional view of the container 10 loaded with the cartons 11 and having the panel 12 thereon, taken at right angles to the sectional view of FIG. 2.

Figure 6:
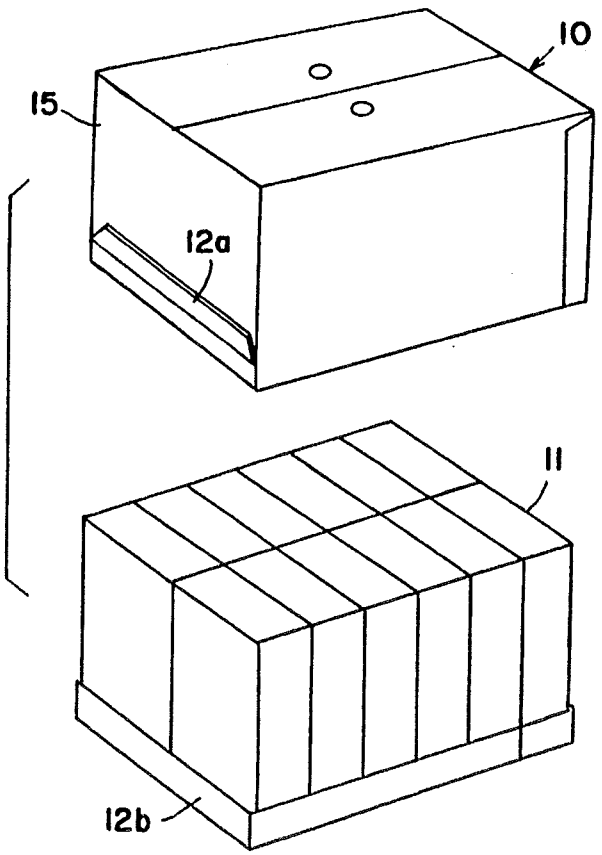
FIG. 6 is an exploded view of the FIG. 4 container with the top removed from the bottom tray thereof with containers therein.
Figure 4:
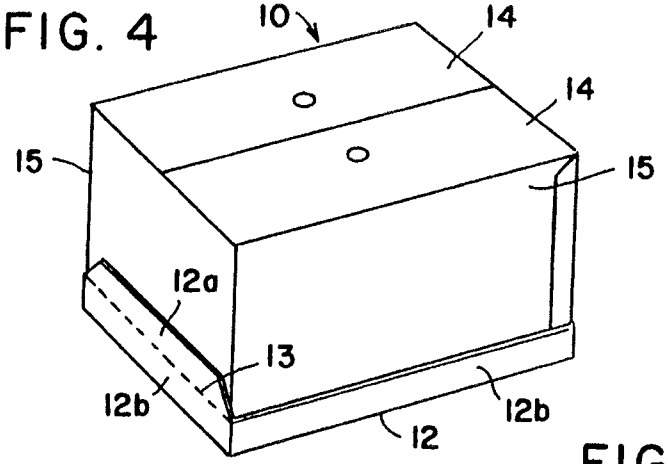
FIG. 4 is a view of the loaded container of FIG. 1 in the display position.
Figure 5:
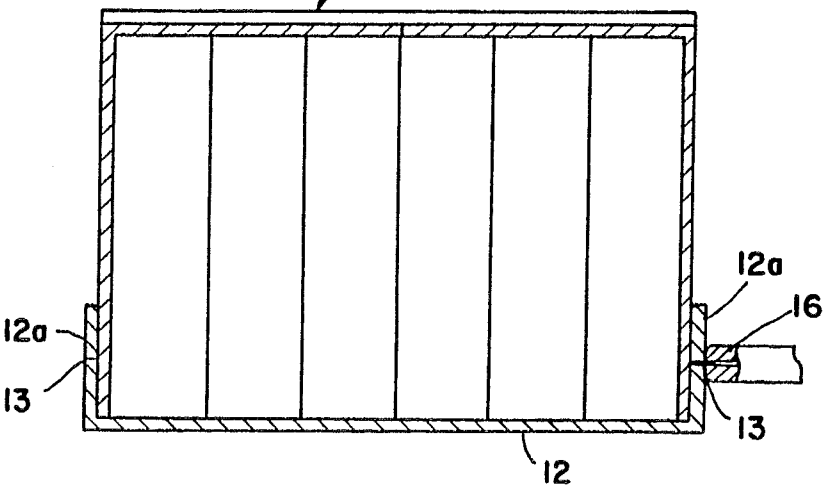
FIG. 5 is a longitudinal sectional view of the FIG. 4 container with cartons loaded therein.

Referring now more particularly to FIGS. 4, 5 and 6, a shipping/display container in its display position is represented in FIG. 4 where top panels 14 and side panels 15 are hingedly attached to form the container 10 which is shown in its display position with the bottom panel 12 and lower side and end panels 12*b* hingedly attached to the bottom panel 12.

The side panels 15 hingedly attach to the top panels 14, 14 are disposed inside the lower side and end panels 12*b* and against the bottom panel 12.

The lower side panels 12*b* have at least two flaps 12*a* attached to at least two lower side panels, preferably end panels, 12*b* at lines of demarcation 13 therebetween. The flaps 12*a* are adhered to the side panels 15 hingedly attached to the top panels 14.

The top panels 14 and the side panels 15 hingedly attached thereto form a half slotted container. The panels and the flaps preferably are of corrugated material. The lines of demarcation 13 preferably are parallel to the bottom panel 12. The lines 13 of demarcation preferably are lines of perforations.

Referring now more particularly to FIG. 5, at the point of display the flaps 12*a* may be cut along the lines of demarcation 13 and the flaps 12*a* which are, for example, glued to the container side panels 15 are then separated from the bottom side panels 12*b*.

As represented in FIG. 6, the container 10 may then be lifted from the bottom panel 12 and the cartons 11 are displayed therein.

The length of the knife blade 16 represented in FIG. 5 is set in accordance with the thickness of the flap 12*a* and the cartons 11 are protected from being cut by the side panels 15 between the knife blade and the cartons 11.

Figure 7:
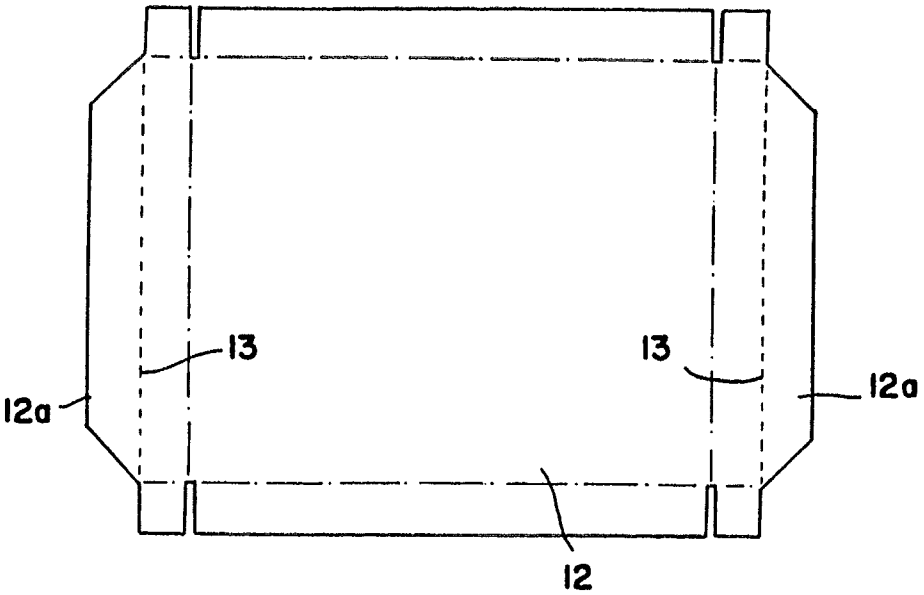
FIG. 7 is a knocked-down flat view of the tray of the FIG. 4 container.

Referring now more particularly to FIG. 7, there is represented a knocked-down flat view of the bottom panel and lower side panels hingedly attached thereto corresponding to the bottom tray 12 of FIG. 4.

Figure 8:
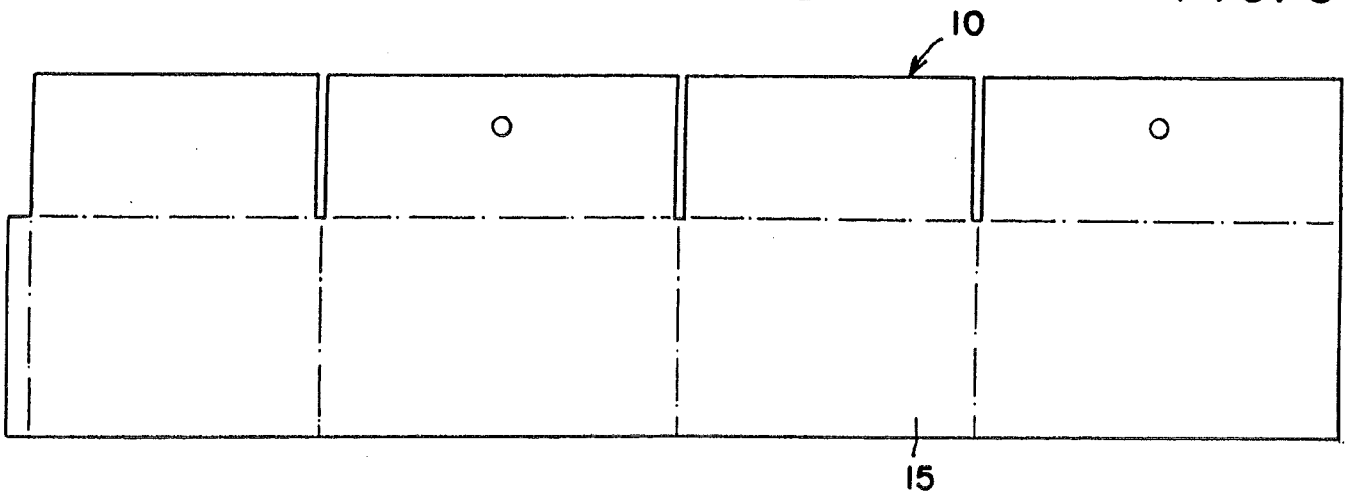
FIG. 8 is a knocked-down flat view of the upper portion of the FIG. 4 container.

Referring now more particularly to FIG. 8, there is represented a knocked-down flat view of the container 10 having panels 14 and 15 thereon.

A prior type of shipping container utilizes a cardboard lid which covers a carton and is maintained in position by suitable parallel strapping around the lid and carton. Such a shipping container might be inverted as suggested by applicants and used as a shipping display container by removing the container body from the contents then supported by the lid.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A container adapted to ship and display a boxed product comprising:

a top panel with side panels hingedly attached thereto forming a shroud;

a bottom panel with lower side panels hingedly attached thereto forming a tray;

the side panels of said shroud being disposed inside the lower side panels of the tray and resting against said bottom panel, thereby encasing said boxed product for shipment;

said lower side panels of the tray having at least two flaps individually attached over substantially the entire lengths of individual ones of said lower side panels to at least two of said lower side panels of the tray at lines of demarcation therebetween, said flaps being adhered to said side panels of said shroud, said flaps being detachable at said lines of demarcation from said lower side panels of the tray and said shroud being removable from the container to display the boxed product.

2. A container in accordance with claim 1 in which said top panel and said side panels hingedly attached thereto form a half slotted container.

3. A container in accordance with claim 1 in which said panels and said flaps are corrugated.

4. A container in accordance with claim 1 in which said lines of demarcation are parallel to said bottom panel.

5. A container in accordance with claim 1 in which the lines of demarcation are lines of perforations.

6. A container in accordance with claim 1 in which said lines of demarcation are straight lines.

7. A container in accordance with claim 1 in which said lines of demarcation are cut.

8. A container in accordance with claim 1 in which said lines of demarcation are broken or torn.

9. A container in accordance with claim 1 in which all of said panels and said flaps are of corrugated material.

10. A container in accordance with claim 1 in which said at least two of said lower side panels below said lines of demarcation and any remaining ones of said lower side panels hingedly attached to said bottom panel have substantially the same height which is substantially constant along said lower side panels of the tray.

11. A container in accordance with claim 1 in which said container has contents comprising said boxed product having a height and said side panels hingedly attached to said top panel have a height at least equal to the height of the contents of said container.

12. A container in accordance with claim 1 in which said lower side panels of the tray include two end panels and in which said flaps are integral with said two end panels.

13. A container in accordance with claim 1 in which said at least two lower side panels individually have only single ones of said lines of demarcation thereon.

* * * * *